US005344346A

United States Patent [19]

Griffin

[11] Patent Number: 5,344,346

[45] Date of Patent: Sep. 6, 1994

[54] DRIVESHAFT HOUSING ATTACHMENT

[76] Inventor: Clarence A. Griffin, 11740 Immokalee Rd., Naples, Fla. 33964

[21] Appl. No.: 117,498

[22] Filed: Sep. 7, 1993

[51] Int. Cl.[5] ..... B63H 5/16

[52] U.S. Cl. ..... 440/66; 440/71; 114/274

[58] Field of Search ..... 440/68, 69, 70, 71, 440/72, 900; 114/271, 274

[56] References Cited

U.S. PATENT DOCUMENTS

| | | | |
|---|---|---|---|
| Re. 18,602 | 9/1932 | Svendsen et al. . | |
| 1,009,635 | 11/1911 | Benson | 440/71 |
| 1,869,977 | 8/1932 | Modin | 440/71 |
| 2,054,374 | 9/1936 | Fuller | 440/71 |
| 2,140,099 | 12/1938 | Wise | 440/71 |
| 2,319,640 | 5/1943 | Sink . | |
| 2,355,842 | 8/1944 | Arado . | |
| 2,470,874 | 5/1949 | Sidney . | |
| 2,717,570 | 9/1955 | Willoughby | 440/71 |
| 2,963,000 | 12/1960 | Fester . | |
| 2,972,977 | 7/1956 | Hausman . | |
| 2,985,133 | 5/1961 | Shaffer . | |
| 3,965,845 | 6/1976 | Lubov . | |
| 4,096,819 | 6/1978 | Evinrude . | |
| 4,565,533 | 1/1986 | Springer | 440/71 |
| 4,680,017 | 7/1987 | Eller | 440/66 |
| 5,207,605 | 5/1993 | Kroeber | 440/71 |

*Primary Examiner*—Stephen P. Avila
*Attorney, Agent, or Firm*—Myron E. Click

[57] ABSTRACT

Apparatus for improving the efficiency of a propulsion unit having a driveshaft housing depending from the stern of a boat, while protecting swimmers and the propulsion unit. A plate member has an upper end to be positioned forward of a driveshaft housing and to depend arcuately downwardly and rearwardly to terminate in a trailing lower end below a propeller. The plate member tapers outwardly along lateral edges from the upper end to the lower end to divert swimmers around and under a housing and a propeller attached thereto. The plate member reacts to the passage of water when under way to urge the boat's stern upwardly toward a more efficient operating position. The outer corner areas of the upper and lower ends are connected by outwardly curved rods to define a protection zone to protect body parts of swimmers by diverting them outwardly and downwardly under a propeller.

20 Claims, 3 Drawing Sheets

DRIVESHAFT HOUSING ATTACHMENT

BACKGROUND OF THE INVENTION

1. Field of the Invention.

This invention relates to attachments for driveshaft housings for boat engines generally and, in particular, for driveshaft housings connecting boat engines such as outboard, inboard-outboard and the like to the propeller. The attachment is designed to protect humans, manatees and other creatures in the water from the propeller, fins, and other parts of the housing, while also protecting the propeller, the fins and the like, and improving the efficiency of operation.

2. Description of the Prior Art.

The prior art has many examples of devices for protecting the propeller and submerged boat propulsion parts. However, these devices do not protect creatures in the water very well. Further, the prior art devices reduce the efficiency of the propulsion units by adding undesirable drag loads. Some of the prior art attachments are removable, which could reduce the drag load after reaching open water, but are really removable only when the boat is essentially in a dock or dry docked situation. Those that could be removed when the boat is under way or in open waters may lose attaching parts and/or are not as stable as desired to reduce vibration problems.

U.S. Pat. Nos. 1,009,635; 1,869,977; Re. 18,602; 2,054,374; 2,140,099; 2,355,842; 2,963,000; 2,985,133, 3,965,845 and 4,096,819 are examples of propeller guards that are essentially permanently attached in that they cannot be readily removed when the boat is under way or in open water. Removability is very desirable, because such guards are added drag loads.

Further, none of the devices protect creatures in the water very well. That is, fins or tines are spaced so far apart that arms, hands, fingers, fins, etc. can go between them and be damaged by the propeller. In some, the circle scribed by the propeller radius extends outside of the protection zone of the guard. In others, a keel-like support portion can do substantial impact damage to a swimming creature. Moreover, in some designs, the skag or gear housing or other parts are forward of the protective zone and can do substantial impact damage. Finally, there are many sharp edges that are harmful, whether designed for cutting weeds or just sharp by the nature of their design.

U.S. Pat. No. 2,470,874 discloses a propeller guard that can be pivoted up out of the water. However, the fork arms provide no protection for swimmers and, in fact, are hazardous themselves because the fork arms have knife-like forward edges.

U.S. Pat. No. 2,972,977 discloses a propeller guard which affords more protection than some of the devices because an object engaging shoe is held behind and below the propeller by a pair of spaced, vertical support arms that are pivotally mounted on the transom. A push block carried about half-way down on the support arms pushes against the forward part of upper housing 16 to pivot the propeller and housing out of the water when the shoe strikes an object under the water.

However, the solid shoe adds a very substantial drag load that reduces the efficiency of the propulsion unit. While the device might be removed if the boat were dead in the water, it is very difficult because, after removal of the mounting from the transom, the unit must be lowered much further into the water so that the push block can be passed below the skeg. If the motor is running and the propeller is turning, removal is very dangerous because either one of the support arms or the push block may strike and damage the propeller. Thus, the outboard motor attachment is essentially permanently mounted because the boat must be either in drydock, or docked with the engine not running, for safe removal.

The shoe might have been designed to assist the boat in planing, either at full speed or at lower speeds in regulated waters. However, not only is there no teaching or suggestion that such was intended, but the upper part 52 of the shoe 50 has a reduced width to space the support arms apart. In addition, upper part 52 is angled toward the rear, so that when the boat is under way water passing over part 52 actually pushes the part 52, downwardly to interfere with any planning effort.

U.S. Pat. No. 2,319,640 discloses a propeller guard which provides a better protection zone than most. However, the blade-like fingers can cut and injure creatures in the water. Further, while the inventor states that his device reduces turbulence, there is still a substantial amount of drag load and turbulence and therefore less efficiency at slower speeds. Therefore it would be very desirable to be able to remove the device when under way and in open water at higher speeds.

However, the guard is attached under the water line to the cavitation plate by a wing nut to a plate bolt. The device is subject to nut loosening and loss of the device as a result of the vibration of the blade-like fingers. To detach the guard, one has to work under water with the possibility of loss of the wing nut and/or guard. Moreover, the nut/bolt combination may corrode, resisting or preventing removal without tools. Thus, this propeller guard is again essentially a permanently mounted device which hampers efficiency at all speeds.

U.S. Pat. No. 4,565,533 discloses a propeller guard which does not provide adequate protection for swimmers, manatees, etc. because the rearwardly extending ribs are much too far apart. However, it does disclose a quick-release system to enable removal under way or in open water to improve propulsion efficiency at higher speeds when swimmers, manatees are not in, or not supposed to be in, the water. While a safety loop 46 on the main body is provided for attachment to a safety line to prevent loss by dropping the guard, the other essential part 44 of the attaching system does not have any means for preventing loss of the part. This is a major flaw since the boat may have to return through swimmer and manatee waters without protection for them.

This device has a further problem in that the ribs are going to vibrate, affecting the stability of the device and increasing turbulence. While a sleeve 38 is provided to receive the skeg, there is a substantial length of the main rib 25 between the skeg and the quick-release that isn't anchored in any way.

U.S. Pat. No. 4,680,017 discloses a propeller guard that isn't satisfactory because of the large drag load, the damage that the sharp edges of ribs 58 can do to swimming creatures, and the inability to easily remove or reinstall the guard in open water or while under way—with the added possibility that the guard may be dropped in the water and lost. However, the device does show a frame member 52 which is channel shaped to extend around leading edge 18 of lower housing 16. This provides structural support for the ribs 58 and protects leading edge 18 and skeg 22 from damage. On the other hand, because water is flowing directly past frame 58 between ribs 58, there is no deflection of a swimmer or a manatee by a diverted water flow, and impact against the frame 58/edge 18 is direct and damaging.

The function of a propeller is to produce thrust along the axis of the propeller shaft to drive the boat or ship, by giving momentum to the water it displaces in an astern direction. In pushing the water backwards, a reaction force is developed to push the craft forward. It is therefore desirable to maintain the axis of the propeller substantially parallel to the horizontal axis of the craft when the hull is in its most efficient operating position in the water. Most craft that will be using this invention will have planing type hulls, as opposed to displacement hulls. The planning type hull operates most efficiently when the stern of the boat is raised by the speed of the boat in open waters. However, this invention will be primarily used in speed restricted waters, and then removed in open water.

As noted above, the prior art devices of this general type add drag load when used. Further, most of them cause substantial turbulence which further reduces the efficiency of the propeller. None of the them react with the water passage to lift the stern of the boat to a more efficient operating position.

Accordingly, it is an object of this invention to provide an attachment which allows the water flow to the propeller to be as free of turbulence as possible, while also reacting with the passage of water to urge the stern of a boat upwardly toward a more efficient operating position.

It is a another object of this invention to provide an improved housing attachment for protecting swimmers of all types from injury by propulsion units of boats, while still providing protection for the propulsion units themselves.

It is a further object of this invention to provide such an improved attachment which is designed to improve the efficiency of the propulsion unit by reducing the effect of the added drag load of such guards.

A still further object of this invention is to provide such an improved attachment that can be readily removed when the boat is out of waters with switching creatures that might be injured, without fear of losing the attachment or damaging the propeller, so that the boat may then be operated at all speeds at top efficiency. It is a further object to be able to readily reinstall the attachment before entering waters with swimmers, manatees, etc.

It is also an object to provide means to insure stability to the attachment structure to prevent undesirable vibration, even though the attachment may be readily removed and re-installed.

BRIEF DESCRIPTION OF THE DRAWINGS

In the drawings, where like numerals are employed to designate like parts throughout.

DESCRIPTION OF PREFERRED EMBODIMENTS

Figure 1:
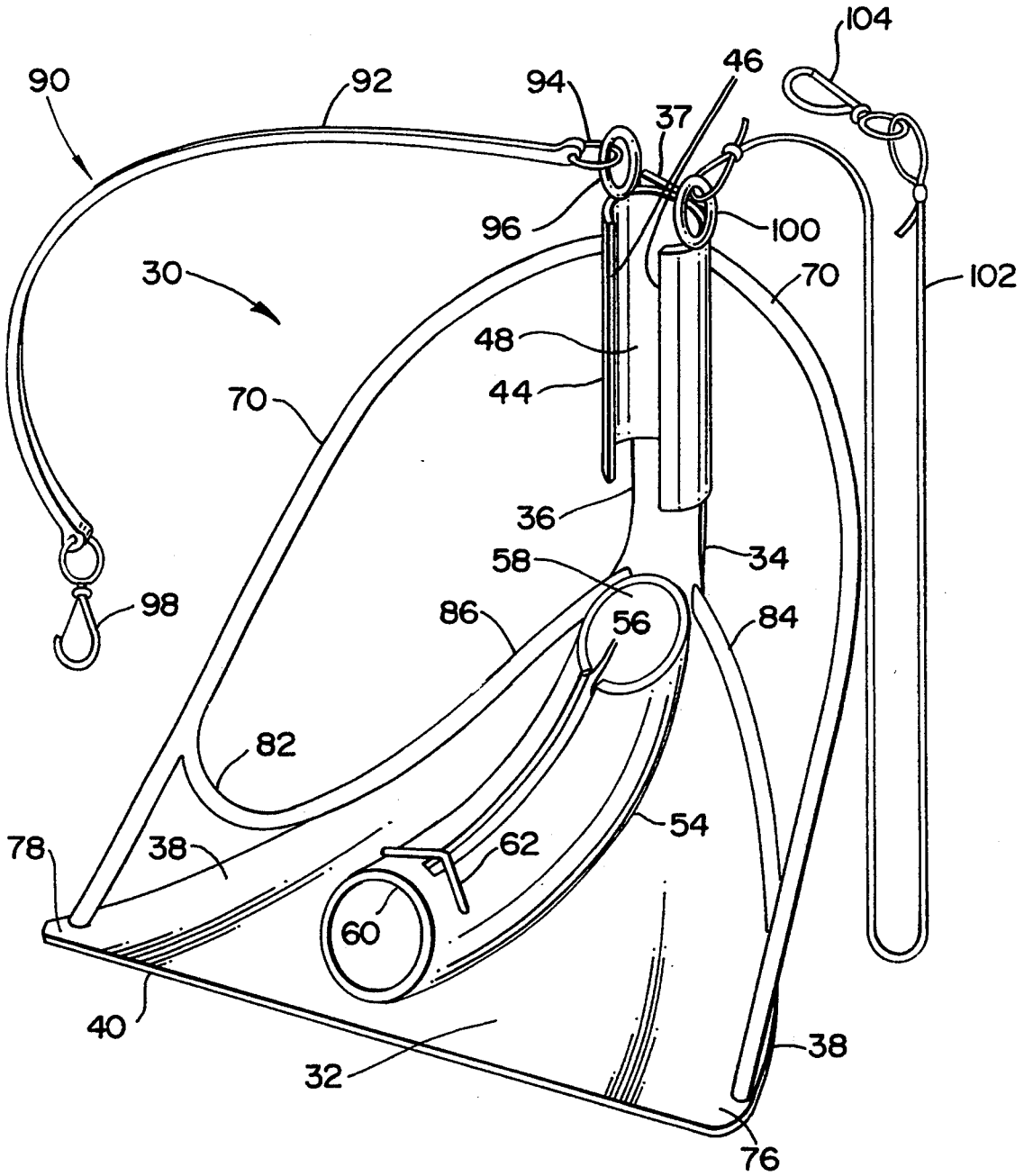
FIG. 1 is a view of perspective of a first embodiment of the attachment of this invention.
Figure 2:
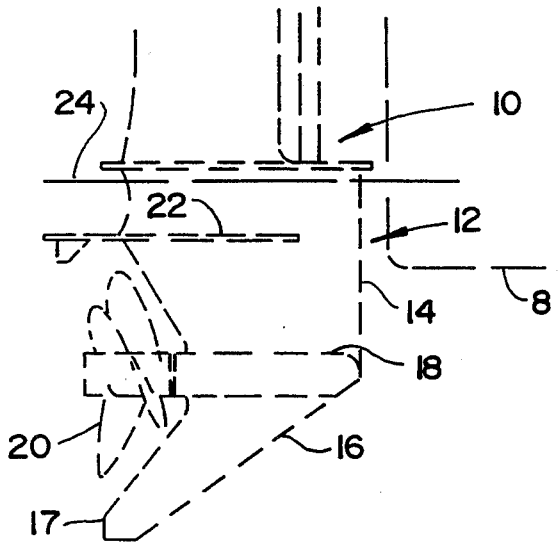
FIGS. 2 and 3 are side and front elevational views of an outboard motor with which this invention may be utilized.
Figure 3:
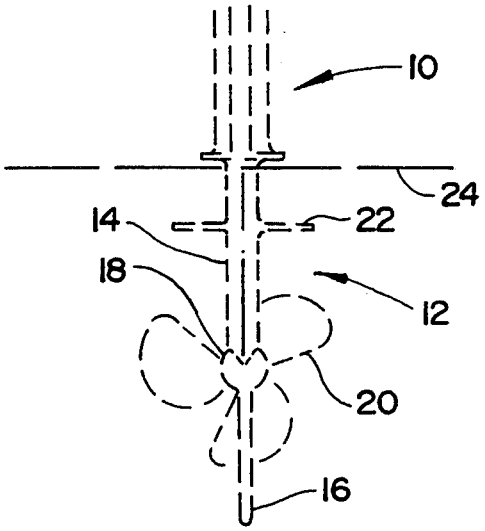
Figure 4:
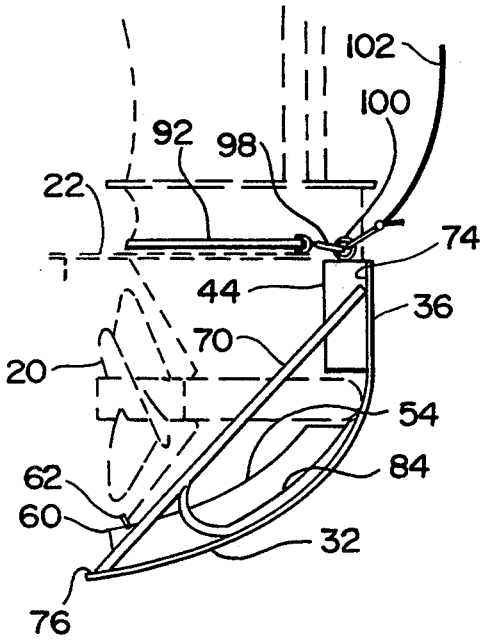
FIGS. 4 and 5 are side and front elevational views of the outboard motor illustrated in FIGS. 2 and 3, with the attachment of this invention mounted thereon.

Referring now to FIGS. 1 through 5 there is illustrated a first embodiment as it appears with an outboard motor or propulsion unit which is generally indicated at 10 suspended from the transom of a boat 8 and best seen in FIGS. 2 and 3. A driveshaft housing indicated generally at 12 has an upper portion 14 of the housing's leading edge and a lower portion 16 of the leading edge. The lower portion of the housing is usually referred to as the skeg and has a trailing edge 17 at the lower tip of the skeg. A propeller gear housing 18 has a shaft extending rearwardly therefrom to carry a propeller 20. A cavitation plate 22 is shown on the upper part of the housing.

The propulsion unit 10 and boat 8 are shown in a generic form merely to illustrate the connection of an attachment indicated generally at 30, and the arrangement of the component parts of an attachment with respect to propulsion unit parts shown in the drawing. A waterline 24 is indicated to give a further idea of component locations.

Figure 5:
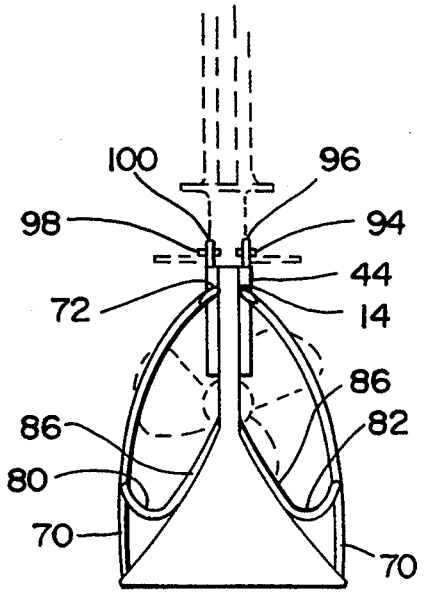

The attachment 30 has a flare plate member 32, which has an upper end 34 to be positioned forward of housing 12 (best seen in FIG. 3), and to depend arcuately downwardly and rearwardly to terminate in a lower trailing edge or end 40 (best seen in FIG. 5). The plate men, her 32 tapers outwardly from the upper end 34 to the lower end 40 to divert swimmers and other objects around and under the housing 12 and propeller 20.

The trailing end 40 preferably extends at least to the vertical plane defined by the end of the propeller hub for two reasons. First, it is desired to prevent injury in the protection zone between the trailing end 40 and the forward part of housing 12. Secondly, this enables the lower face of plate 32 to have a larger surface to react with the passage of water when under way to urge a boat stern upwardly toward a more efficient planing position, even at relatively slower boat speeds.

A means 44 connected to the upper end 34 of plate 32 is provided for receiving the leading edge of the upper portion 14 of housing 12. The means 44 has a configuration which maintains the upper end 34 aligned with the driveshaft housing, and which also reduces or eliminates vibration of the attachment 30 in that area. The means 44 provides spaced surfaces 46 to the rear of upper end 34 for engaging the sides of the housing 12 to the rear of the leading edge to prevent lateral movement of upper end 34. The spaced surfaces 46 are preferably separated far enough to permit the leading edge to seat at 48 in a position adjacent to the upper end 34, so that a cross-section of the upper leading edge has at least three points of contact to insure stability.

In this first embodiment the above is accomplished by including an upward extension or spine portion 36 as part of upper end 34, the spine 36 extending upwardly in substantially vertical alignment with the leading edge of the upper portion 14 of the housing 12. While there may be alternative structures, the function of the means 44 is accomplished by welding or otherwise fastening a tube to the spine, with the tube having a vertical slot formed therein.

Similarly, a means 54 is carried on and connected to the lower end of plate 32 above the trailing edge or end 40 for receiving the leading edge of the skeg or the lower portion 16 of housing 12. The means 54 has a configuration which maintains the lower end or trailing edge in lateral alignment with the axis of housing 12, and which reduces or eliminates vibration of the attachment 30 in that area. The means 54 provides spaced surfaces 56 to the rear of plate 32 for engaging the sides of the skeg 16 to the rear of the leading edge of the skeg to prevent lateral movement of the trailing end 40. The surfaces 56 are advantageously separated far enough to permit the leading edge of the skeg to seat at 58 in a position adjacent the lower end of plate member 32, so that a cross-section of the skeg has at least three points of contact to insure stability.

Finally, the skeg receiving means 54 includes means for engaging both a forward surface and a trailing surface of the skeg 16 at the tip 17 to secure the skeg in a fixed position with respect to the plate men%her 32, both vertically and laterally.

In the first embodiment the skeg receiving is accomplished by connecting a tube, which has been formed with a curvature that corresponds to the curvature of the arcuate plate, to the upper surface of plate 32 by welding or other fastening means. A slot is formed in the tube which is open at the upper end and closed at the lower end 60. The termination of the slot, if the tube has a large enough diameter, may engage the top of the trailing edge of the skeg to hold the skeg in a fixed position. If the skeg is thicker at the tip than the diameter of the tube, then a skeg tip retainer 62 in the form of an inverted "V" may be connected to the tube with the apex of the "V" aligned with the slot.

These receiving means not only stabilize the attachment 30, but also act as guides, and assist in mounting the attachment 30 on the housing 12. That is, the tip 17 of the skeg is placed in the tip retaining means and the attachment 30 is pulled upwardly until the skeg is seated in the retainer. The attachment is then moved toward the housing until the slots engage the sides of the housing. The attachment is then automatically in position to be releasably secured to the housing.

The upper end 34 and the lower end 40 of plate 32 each have oppositely disposed corner areas 72,74 and 76,78, respectively, near the lateral edges 38,38 thereof. (Best seen in FIGS. 1 and 5.) Shunt rod means 70,70 extend between corner areas 72,76 and 74,78, the connected pairs of corner areas being on opposite sides of the attachment 30. The rods 70,70 maintain the structural integrity of plate member 32, and enable the use of a material for the plate which is thinner and therefore lighter, making the attachment easier to lift and handle.

Further, the rods make it possible to form the plate not only from a metal, such as stainless steel, but also from material such as reinforced plastic. If plastic is used, it would be possible to form the leading edge receiving means 44,54 integral with and at the same time the plate 32 is formed, to further reduce the cost and weight of the attachment.

It is advantageous to form the rods 70,70 to be curved outwardly away from the vertical axis of the attachment. As best seen in FIG. 5 the curvature of rods 70 is such that a protective zone is defined forward of propeller 20. Since the rods to also extend downwardly, in addition to their outward curvature, swimmers and other objects are shunted or diverted downwardly and outwardly away from propeller 20. This prevents injury to swimmers and damage to the propeller.

As a further improvement, curved surface members 80,82 are positioned between rods 70,70 and the lower end 40 and lateral edges 38,38 of plate 32. (Best seen in FIGS. 1, 4 and 5.) Each of the curved surfaces open toward the forward side of the plate member 32, or the direction of travel when under way. Thus, they are able to intercept and prevent appendages and other body parts from reaching the propeller 20, or lodging or wedging in the intersections of the lower ends of rods 70,70 and plate member 32. If wedging occurs, the swimmer's body part might not reach the propeller, but the swimmer could be held under water until drowned.

The curved surface members 80,82 may be formed from rods, preferably rounded, as shown in the drawings. They may also be formed from plastic, for example as a component that is substantially triangular, and which fits in the acute angle area between an intersecting rod and plate member. A curved surface would be formed in a U-shape which opens forwardly.

If rods are used for the curved members 80,82, in the U-shape shown, a leg 84,86 of the "U" may be extended forwardly along the tapered edges 38 of the plate members 32. This provides a rounded surface along each edge to prevent or reduce damage to bodily parts contacting the edges.

A releasable securing means is generally indicated at 90 in FIG. 1. The means 90 includes a length of material 92 having elastic properties, such as bungee cord. A ring 94 on one end of cord 92 connects that end to an eyelet 96 welded or otherwise fastened to the upper part of the attachment 30. A spring clip 98 is carried on the other end of cord 92 for releasably securing the cord to an eyelet 100 welded or otherwise secured to the top of attachment 30.

As noted hereinbefore, the skeg tip 17 is inserted into the inverted "V" 62, the attachment 30 pivoted into the leading edge receiving means 44,54, and the attachment pulled up to set the skeg tip in the engaging means 62. The top of the attachment is now in a position to be releasably secured to the housing. The spring clip 98 is pulled around the housing 12 and the cord 92 is stretched so that spring clip 98 can be connected to eyelet 100. This arrangement has the advantage of acting as a shock absorber because the cord 92 will stretch in response to contact with an object in the water, but will pull the attachment 30 back into operative position after that contact.

A means for securing the attachment to a boat to prevent loss thereof during any change is illustrated in FIG. 1. One end of a tether 102 is secured to the eyelet 100 on the attachment, while the other end of the tether 102 carries a spring clip 104 which may be selectively connected to a suitable fastener on the boat.

Figure 6:
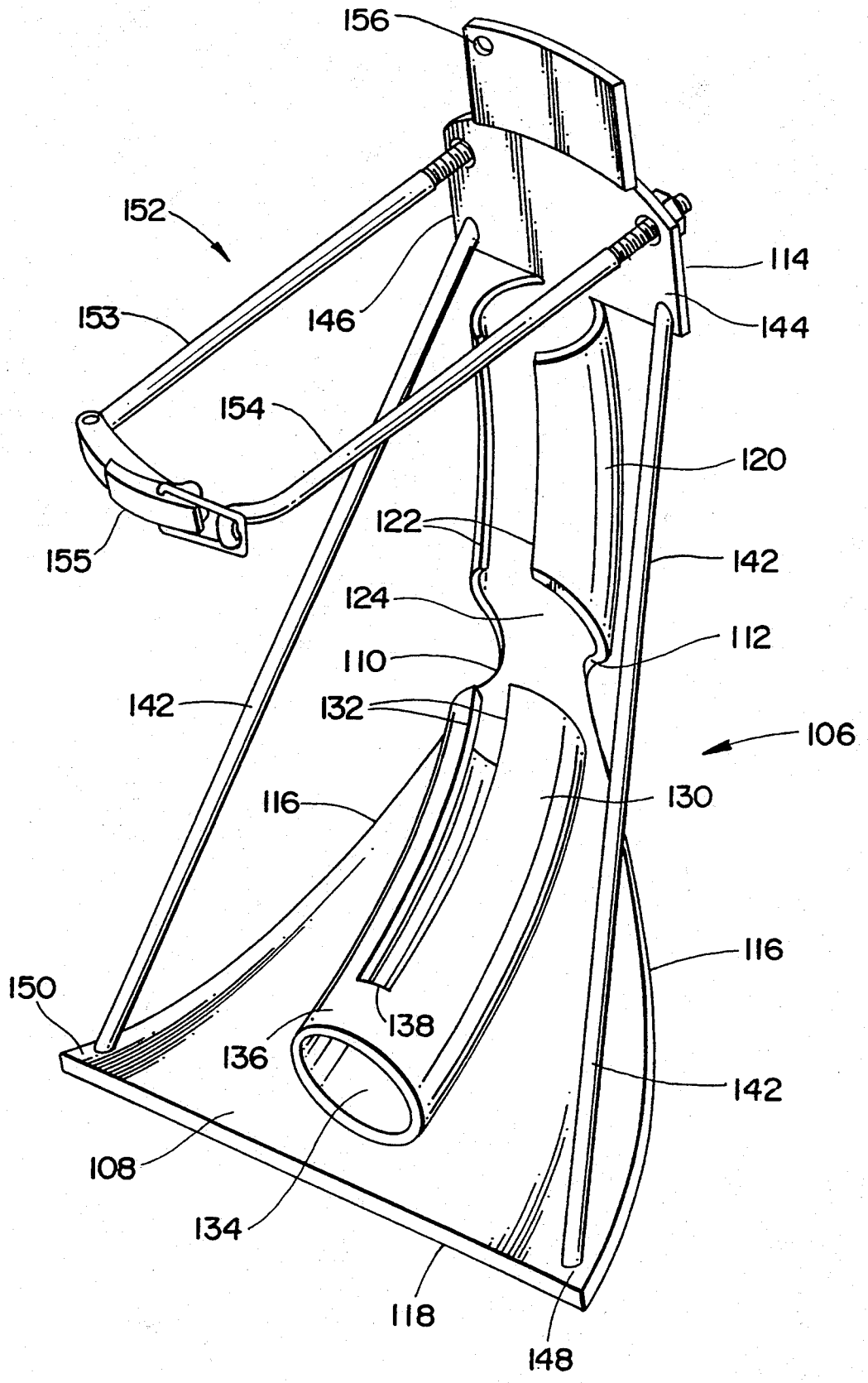
FIG. 6 is a view in perspective of a second embodiment of this invention.

Referring now to FIG. 6, there is illustrated a second embodiment of this invention. While many components are similar to those in the first embodiment and have similar or identical functions, there are illustrated alternate approaches.

An attachment is indicated generally at 106. A flare plate member 108 has an upper end 110. A spine or extension portion 112 of upper end 110 is to be positioned substantially vertically forward of an upper portion of a driveshaft housing. The flare plate member 108 depends arcuately downwardly and rearwardly to terminate in a lower trailing edge or end 118. The plate member 108 tapers outwardly from the upper end 110 along tapering lateral sides or edges 116 to the lower end 118 to divert swimmers and other objects around and under the housing and propeller.

As in the first embodiment, the trailing end 118 is extended sufficiently far to meet two design criteria for a particular housing, propulsion unit and boat. First, it is extended far enough to prevent injury in the protection zone to be covered. Second, it is extended far enough to provide enough lower surface on the plate to react with water passage to urge a boat stern upwardly to a more efficient operating position, particularly at slower speeds.

Instead of having a separate component to receive the upper portion of the leading edge of the housing, this embodiment is formed from a single piece. The flare pate 108, upper end 110, lower end 118, and tapered edges 116 may be cut and formed from a single piece. The spine or extension portion 112, and the laterally extended wings section 114 are also cut or formed from the same single piece, with the sides of an upper housing leading edge receiving means 120 being flat. A cut is made on each side at the bottom of the upper spine wing members 114 and the originally cut flat sides of receiving means 120 are rolled up toward each other to provide the tubular type configuration shown in FIG. 6, with opposing spaced surfaces 122 for engaging the sides of the leading edge. So, the back 124 of the tubular configuration takes the place of the spine member in the first embodiment, and also acts as the seating area for the leading edge.

The lower housing receiving means 130 is carried on and connected to the lower end of plate 108, as in the first embodiment. Spaced surfaces 132 are provided by a slot formed in the tubular configuration. The bottom of the tube provides a seat 134 for the skeg. The slot terminates at 138 at the lower end 136 of the tube. In this embodiment, it is assumed that the diameter of the tube is sufficient so that the tube can fit over the trailing edge of the skeg tip to hold the skeg tip in a fixed position. It should be noted, however, that it is not necessary for the skeg tip trailing edge to be engaged, but it does provide the advantages discussed hereinbefore in the description of the first embodiment.

As in the first embodiment, the plate 108 has an upper portion above the middle including the upper end, and a lower portion below the middle including the lower end. In this instance, the upper portion and the lower portion of plate 108 each have oppositely disposed attachment areas near the lateral edges or edges. This embodiment differs by having the wings of the laterally extended upper portion available for oppositely disposed attachment areas 144,146. The lower portions of plate 108 has oppositely disposed attachment areas 148,150 In this embodiment, shunt rods 142 extend between attachment areas 144,148 and 146,150, respectively. Curved surface members may be also provided at the intersections of the shunt rods 144,142 with the lower portion of the plate to eject appendages and body parts, as discussed hereinbefore.

A releasably securing means 152 includes two legs 153,154 connected by a latch portion 155 to from a U-shaped connector. The two legs 153,154 of the U-shaped yoke 152 are disposed with respect to each other to receive the housing therebetween, and maintained in that disposed position by threaded outer ends inserted through bores formed in the laterally extended wings of upper end portion 114, and secured in that position with nuts on one or both sides of the bores. The quick-release latch portion 155 closes the "U" around the housing to retain the attachment in place. The size of the yoke can be adjusted by the positions of the bolts on the threaded outer ends of the legs 153,154.

When the function and advantages of the components in FIG. 6 are the same as that already discussed hereinbefore for the first embodiment, that discussion has not been repeated for the second embodiment.

It is to be understood that the two embodiments disclosed have been based upon a "generic" propulsion unit with an engine, driveshaft housing and associated propeller in order to illustrate the principles involved. Thus, the specific design may be modified for particularly outboard or inboard-outboard or other applicable propulsion units. For example, the dimensions, degree of curvature, etc. of the flare plate may be modified to best achieve the desired design criteria of protecting swimmers and propeller, while achieving the most efficient operation of the propulsion unit.

With respect to both of the embodiments disclosed herein, the flare plate member depends arcuately downwardly and rearwardly to terminate in a trailing lower end. The upper end is preferably relatively narrow, advantageously no wider than the housing. This narrowness preferably commences below the propeller gear housing, and preferably does not exceed the width of the housing in any upward extension, such as the spine extensions described herein.

The tapering outwardly from that lower portion of the upper end is such that preferably no more than 90 degrees of a cylinder, generated by a circle scribed by the tips of the propeller blades as the propeller moves through the water, is obscured. The most advantageous scope of taper is approximately 75 degrees, as best seen in FIG. 5, between the outer or lateral edges of the upper end at or below the propeller gear housing or propeller axis, and the outer or lateral edges of the trailing end or edge. This allows the maximum volume of relatively non-turbulent water to reach the propeller, while providing sufficient arcuate lower surface to react with water passage to lift the stern of the boat.

While the above-noted plate member configuration is the most desirable from the standpoint of attaining maximum non-turbulent water flow to the propeller and attaining the desired lift, it is also desirable to provide additional protection for swimmers. This is provided by the shunt rods, which are curved outwardly away from the vertical axis of the attachment to define a protection zone (as best seen in FIG. 5) for swimmers that substantially covers the propeller turning circle. It is not necessary that the shunt rods be outside of the propeller circle, because in addition to curving outwardly the shunt rods extend downwardly, so that when an object encounters the shunt rods it is diverted outwardly and downwardly away from the propeller. Finally since there are only two shunt rods having relatively small diameters or thicknesses, and since they are located in the outer area of the circle scribed by the propeller, there is very little turbulence generated that would interfere with the efficiency of operation of the propeller.

Therefore, while the choice of the specific components and their arrangement in the preferred embodiments described herein illustrated the results and advantages obtained by the choice of those specific components over the prior art, the invention is not limited to those components and their arrangement. Thus, the forms of the invention shown and described are to be taken as illustrative, and changes in the components or their arrangement may be made without departing from the spirit and scope of this invention. There has been disclosed apparatus which differs structurally from, provides functions not performed by, and has clear advantages over the prior art.

SUMMARY OF THE INVENTION

An apparatus and an attachment improves the efficiency of a propulsion unit having a driveshaft housing depending from the stern of a boat, while protecting both swimmers and the propulsion unit.

A plate member has an upper end to be positioned forward of a driveshaft housing, and to depend arcuately downwardly and rearwardly to terminate in a trailing lower end below a propeller carried on the housing. The plate member tapers outwardly along lateral edges from the upper end of the lower end to divert swimmers around and under a housing and a propeller. The plate member reacts to the passage of water when a boat is under way to urge a boat's stern upwardly toward a more efficient operating position. Means are provided for removably attaching the plate member to a drivershaft housing.

The tapered lateral edges preferably define an angle not exceeding 90 degrees for more efficient operation, with the angle advantageously not exceeding 75 degrees for the most efficient operation while still protecting swimmers and the housing unit.

The upper end and the lower ends of the plate member each have oppositely disposed corner areas near the lateral edges. Means are provided which extend between corner areas on the same side of the plate member for diverting objects away from a propeller area. The corner area extending means are preferably curved outwardly between the upper and lower corner areas to define a protection zone to protect body parts of swimmers by diverting them outwardly and downwardly and under a propeller.

A curved surface member is advantageously positioned between each of the extending means and the plate member to divert body parts from lodging and wedging in the intersection between each of the corner extending means and the lower end of the plate member.

The means for removable attaching the plate member to a driveshaft include a configuration attached to the upper end for receiving a leading edge of an upper portion of a driveshaft housing to maintain the upper end aligned with the housing and to reduce vibration. The means for removable attaching the plate member further advantageously includes a configuration for receiving a skeg at the bottom of the housing to maintain the lower end aligned with the housing and to reduce vibration. The upper end of the plate member is releasably secured to the housing.

The configurations just discussed preferably include spaced surfaces for engaging the sides of the housing to the rear of the leading edges thereof to prevent lateral movement of the plate member. Further, the spaced surfaces are separated for enough to permit the leading edges to seat in a position adjacent to the plate member or an extension thereof, so that a cross-section of the leading edge has a three point contact to insure stability.

Finally, means are provided for securing the attachment to a boat to prevent loss of the attachment when removing or installing the attachment and plate member to a boat.

I claim:

1. An attachment for a driveshaft housing of a boat propulsion unit for protecting swimming creatures in the water from the housing and associated propeller and for protecting the propeller, while improving the efficiency of the propulsion unit, comprising;

(a) a plate member having an upper end adapted to be positioned forward of a housing and to depend arcuately downwardly and rearwardly to terminate in a trailing lower end, said plate member tapering outwardly along lateral edges from said upper end to said lower end to divert swimmers around and under a housing and propeller, said downward and rearward configuration of said plate member reacting to the passage of water when under way to urge a boat's stern upwardly toward a more efficient operating position, (b) means connected to said upper end of said plate member having a configuration for receiving a leading edge of an upper portion of a driveshaft housing to maintain said upper end aligned with the driveshaft housing and to reduce vibration, (c) means connected to said lower end of said plate member having a configuration for receiving a skeg at the bottom of a housing to maintain said lower end aligned with the driveshaft housing and to reduce vibration, and (d) means for releasably securing said upper end of said plate to a driveshaft housing.

2. An attachment as defined in claim 1 in which (a) said upper end and said lower end of said plate member each have oppositely disposed corner areas near the lateral edges thereof, and which further includes (b) means connected to and extending between said corner areas which are on the same side of said attachment for maintaining the structural integrity of said plate member.

3. An attachment as defined in claim 2 in which (a) said corner area connecting means are rod means, and in which (b) said rod means are curved outwardly from each of said upper end corner areas to define a protection zone whereby appendages or other body parts of creatures and other objects are diverted away from a propeller.

4. An attachment as defined in claim 3 which further includes a curved surface member positioned between each of said rod means and said lower end of said plate member, each of said curved surfaces opening toward the forward side of said plate member to intercept and prevent body parts from lodging at the intersection of each rod means and said lower end of said plate member.

5. An attachment as defined in claim 4 in which each of said curved surface members is formed from a rod curved into a U-shaped member.

6. An attachment as defined in claim 5 in which each of said U-shaped curved surface rods has a leg of the "U" extended forwardly along said tapering edge of said plate member to provide a rounded surface along each tapered edge to reduce damage to body parts contacting said tapered edges.

7. Apparatus for improving the efficiency of a propulsion unit having a driveshaft housing depending from the stern of a boat while protecting swimmers and the propulsion unit, comprising;

(a) a plate member having an upper end adapted to be positioned forward of a driveshaft housing and to depend downwardly and rearwardly to terminate in a trailing lower end below a propeller, said plate member tapering outwardly along lateral edges from said upper end to said lower end to divert swimmers around and under a housing and a propeller attached thereto, said plate member reacting to the passage of water when under way to urge a boat's stern upwardly toward a more efficient operating position, and (b) means for removably attaching said plate member to a driveshaft housing.

8. Apparatus as defined in claim 7 in which said tapered lateral edges define an angle not exceeding 90 degrees.

9. Apparatus as defined in claim 7 which further includes means on each side of said plate member extending between an upper portion and a lower portion of said plate member near each side thereof for diverting objects away from a propeller area.

10. Apparatus as defined in claim 9 in which said extending means curve outwardly between said upper and lower portions to define a protection zone to protect body parts of swimmers by diverting them downwardly and under a propeller.

11. Apparatus as defined in claim 9 in which each said extending means includes a curved surface adjacent said lower portion of said plate member to divert and prevent objects from lodging between said extending means and said lower portion of said plate member.

12. Apparatus as defined in claim 7 which further includes means for aligning said upper end with an upper portion of a driveshaft housing to maintain said upper end aligned with the driveshaft housing.

13. Apparatus as defined in claim 12 in which said alignment means includes means for providing spaced surfaces to the rear of said upper portion of said plate member for engaging the sides of the upper portion of a leading edge of a housing to prevent lateral movement of said plate member.

14. Apparatus as defined in claim 13 in which said spaced surfaces are separated far enough to permit the leading edge to seat in a position adjacent said upper portion of said plate member so that a cross-section of the upper leading edge has at least three point contact therewith to insure stability.

15. Apparatus as defined in claim 7 which further includes means for aligning the lower portion of said plate member with the driveshaft housing and to reduce vibration.

16. Apparatus as defined in claim 15 in which said lower portion aligning means includes means for engaging both a forward surface and a trailing surface of a skeg of a housing to secure the skeg in a fixed position with respect to said lower portion of said plate member.

17. Apparatus as defined in claim 15 in which said lower portion aligning means includes means for providing spaced surfaces for engaging the sides of a forward surface of a skeg to prevent lateral movement thereof.

18. Apparatus as defined in claim 17 in which said spaced surfaces of said lower portion aligning means are spaced far enough to permit the forward edge of a skeg to seat in a position adjacent to said lower portion of said plate member so that a cross-section of a skeg has at least three point contact therewith to insure stability.

19. Apparatus as defined in claim 7 in which said means for removably attaching said plate member to a housing includes a length of material having elastic properties, and means for connecting each end of said length of material to said attachment whereby said elastic material is stretched around a housing to secure said plate member thereto and to provide shock absorbing when said plate member encounters an object in the water.

20. Apparatus as defined in claim 7 in which said means for removably attaching said plate member to a housing includes U-shaped means having two legs of the "U" disposed with respect to each other to receive the housing therebetween when the outer ends of said two legs are connected to said plate member, and in which the portion of said "U" connecting said two legs includes a latch means for closing the legs of the "U" around the sides of the housing and retaining said plate member on the housing.

* * * * *